US010022970B2

(12) United States Patent
Okina et al.

(10) Patent No.: US 10,022,970 B2
(45) Date of Patent: Jul. 17, 2018

(54) LIQUID EJECTING APPARATUS

(71) Applicant: SEIKO EPSON CORPORATION, Tokyo (JP)

(72) Inventors: Takuya Okina, Shiojiri (JP); Hirokazu Ono, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/250,095

(22) Filed: Aug. 29, 2016

(65) Prior Publication Data

US 2017/0072694 A1 Mar. 16, 2017

(30) Foreign Application Priority Data

Sep. 10, 2015 (JP) ..... 2015-178235

(51) Int. Cl.

| | |
|---|---|
| ***B41J 2/165*** | (2006.01) |
| ***B41J 2/14*** | (2006.01) |
| ***B41J 2/04*** | (2006.01) |
| ***B41J 2/155*** | (2006.01) |

(52) U.S. Cl.

CPC ..... *B41J 2/16535* (2013.01); *B41J 2/04* (2013.01); *B41J 2/1433* (2013.01); *B41J 2/14201* (2013.01); *B41J 2/155* (2013.01); *B41J 2/16538* (2013.01); *B41J 2/16585* (2013.01); *B41J 2202/21* (2013.01)

(58) Field of Classification Search

CPC ..... B41J 2/165; B41J 2002/16502; B41J 2/16505; B41J 2/16511; B41J 2/16514; B41J 2/16517; B41J 2/16535; B41J 2/16538; B41J 2/16541; B41J 2/16544; B41J 2/16547

See application file for complete search history.

(56) References Cited

U.S. PATENT DOCUMENTS

2012/0120150 A1 5/2012 Ando

FOREIGN PATENT DOCUMENTS

| | | | |
|---|---|---|---|
| JP | 62-169654 | * 7/1987 | |
| JP | 03-153359 | * 1/1991 | ..... B41J 2/165 |
| JP | 2007-276394 | 10/2007 | |
| JP | 2007-283692 | 11/2007 | |
| JP | 2008-260133 | 10/2008 | |
| JP | 2011-168032 | 9/2011 | |
| WO | 2014-069497 | 5/2014 | |

OTHER PUBLICATIONS

Computer generated translation of JP 62-169654, published on Jul. 1987.*

Computer-generated translation of JP 2011-168032, published on Sep. 1, 2011.*

European Search Report for Application No. 16187617.2 dated Jan. 4, 2017.

* cited by examiner

*Primary Examiner* — Huan Tran

(74) *Attorney, Agent, or Firm* — Workman Nydegger

(57) ABSTRACT

A liquid ejecting apparatus includes a liquid ejecting section and a protective member. The liquid ejecting section has an aperture surface having ejection outlets that eject liquid droplets. The protective member has passage openings through which the liquid droplets pass. The protective member is disposed between a medium and the aperture surface when the liquid ejecting section ejects liquid droplets onto the medium.

9 Claims, 7 Drawing Sheets

LIQUID EJECTING APPARATUS

BACKGROUND

1. Technical Field

The present invention relates to a liquid ejecting apparatus such as a printer or the like.

2. Related Art

An example of a liquid ejecting apparatus is an ink jet printer (see, for example, JP-A-2007-276394) that has a nozzle plate on which nozzles of a liquid droplet ejecting head are formed. A shutter capable of sliding is mounted on the nozzle plate. The shutter has aperture portions that expose the nozzles. When ink droplets are not ejected from the nozzles, the shutter covers the nozzles in order to keep them from drying out.

Incidentally, when liquid droplets are ejected from the liquid droplet ejecting head, minute liquid droplets occur as mist in response to ejection of target liquid droplets; the mist attaches to an aperture surface and increasingly forms gathered liquid. The gathered liquid may fall onto print paper, or ejected liquid droplets may come into contact with the gathered liquid and change their trajectory. In addition to these problems, aside from the mist, dust such as paper powder attached to print paper may become attached to the aperture surface; these attachments may contaminate the print paper or come into contact with the ejected liquid droplets and change their trajectory.

If the above shutter is provided, foreign materials such as mist and dust will not become attached to a portion of the aperture surface covered with the shutter. Thus, contamination of the aperture surface can be avoided. This shutter, however, is designed to block the nozzles, so when the aperture portions that expose the nozzles are large, for example, attachment of foreign materials may not be sufficiently suppressed.

These problems are generally common to a printer equipped with a shutter that slides along the nozzle plate as well as to a liquid ejecting apparatus that ejects liquid droplets.

SUMMARY

An advantage of some aspects of the invention is that it provides a liquid ejecting apparatus which is capable of suppressing attachment of foreign material to an aperture surface having ejection outlets for liquid droplets.

Next, a solution to the above problems and its operation will be described.

A liquid ejecting apparatus according to an aspect of the invention includes a liquid ejecting section with an aperture surface having ejection outlets that eject liquid droplets; and a protective member having passage openings that enable the liquid droplets to pass. The protective member is disposed between a medium and the aperture surface when the liquid ejecting section ejects liquid droplets onto the medium.

According to this configuration, the protective member is disposed between the medium and the aperture surface when the liquid ejecting section ejects liquid droplets onto the medium. Thus, foreign material such as mist that occurs in association with ejection of liquid droplets becomes attached to the protective member before attaching to the aperture surface. This configuration can suppress attachment of the foreign material to the aperture surface having ejection outlets for liquid droplets.

It is preferable that the above liquid ejecting apparatus further include a wiping member capable of wiping the protective member at a retracted position and the protective member be capable of moving relative to the liquid ejecting section between a protection position and the retracted position that is distant from the liquid ejecting section compared to the protection position. The protection position is a position that faces the aperture surface in such a manner that the ejection outlets and the passage openings align in a liquid droplet ejecting direction.

According to this configuration, mist and the like that occur in association with ejection of liquid droplets become attached to the protective member disposed between the liquid ejecting section and the medium. These foreign materials attached to the protective member can be removed by the wiping member, which wipes the protective member at the retracted position. By wiping the protective member, which accepts mist and the like instead of the aperture surface, the frequency with which the aperture surface is wiped can be reduced. The load of wiping on the aperture surface can therefore be decreased.

In the above liquid ejecting apparatus, the protective member may be disposed distant to the aperture surface and the protective member may be more liquid-repellent on a portion facing the medium than on a portion facing the liquid ejecting section.

According to this configuration, the protective member is configured so as to be more liquid-repellent on a portion facing the medium than on a portion facing the aperture surface. In this case, even when mist that occurs in association with ejection of liquid droplets becomes attached to the portion of the protective member facing the medium, the liquid can be moved through the passage openings and the like to the portion of the protective member facing the aperture surface. This can prevent the medium from being contaminated with liquid attached to the portion of the protective member facing the medium.

It is preferable that the above liquid ejecting apparatus further include a cleaning member that cleans a protection surface of the protective member and the protection surface of the protective member face the aperture surface at a distance to the aperture surface when the protective member is disposed between the medium and the aperture surface.

According to this configuration, the cleaning member cleans the protection surface of the protective member. This can prevent foreign material that is to be attached to the protection surface from attaching to the aperture surface.

In the above liquid ejecting apparatus, the protective member may be disposed at a closed position to cover the ejection outlets when the liquid ejecting section is not ejecting liquid droplets.

According to this configuration, when the liquid ejecting section is not ejecting liquid droplets, the protective member is disposed at the closed position to cover the ejection outlets. This can prevent drying of the ejection outlets.

It is preferable that the above liquid ejecting apparatus further include a pressurizing mechanism that, when the protective member is disposed at the facing position, pressurizes liquid in the liquid path to force out a liquid surface from the ejection outlets; the liquid ejecting section include the liquid path that supplies liquid to the ejection outlets; the protective member have a protection surface that faces the aperture surface at a distance to the aperture surface when the protective member is disposed between the medium and the aperture surface; and the protection surface be disposed at a facing position that faces the ejection outlets when the liquid ejecting section is not ejecting liquid droplets.

According to this configuration, liquid is forced out from the ejection outlets when the protective member is disposed at the facing position; the forced out liquid attaches to the protection surface. A gap between the ejection outlets and the protection surface can be sealed with liquid to prevent drying of the ejection outlets.

In the above liquid ejecting apparatus, the protection surface of the protective member may include a liquid-repellent film.

According to this configuration, the protection surface of the protective member has a liquid-repellent film. Even when liquid attaches to the protection surface, this configuration can prevent that liquid from adhering to the protection surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of a liquid ejecting apparatus will now be described with reference to the accompanying drawings.

Figure 1:
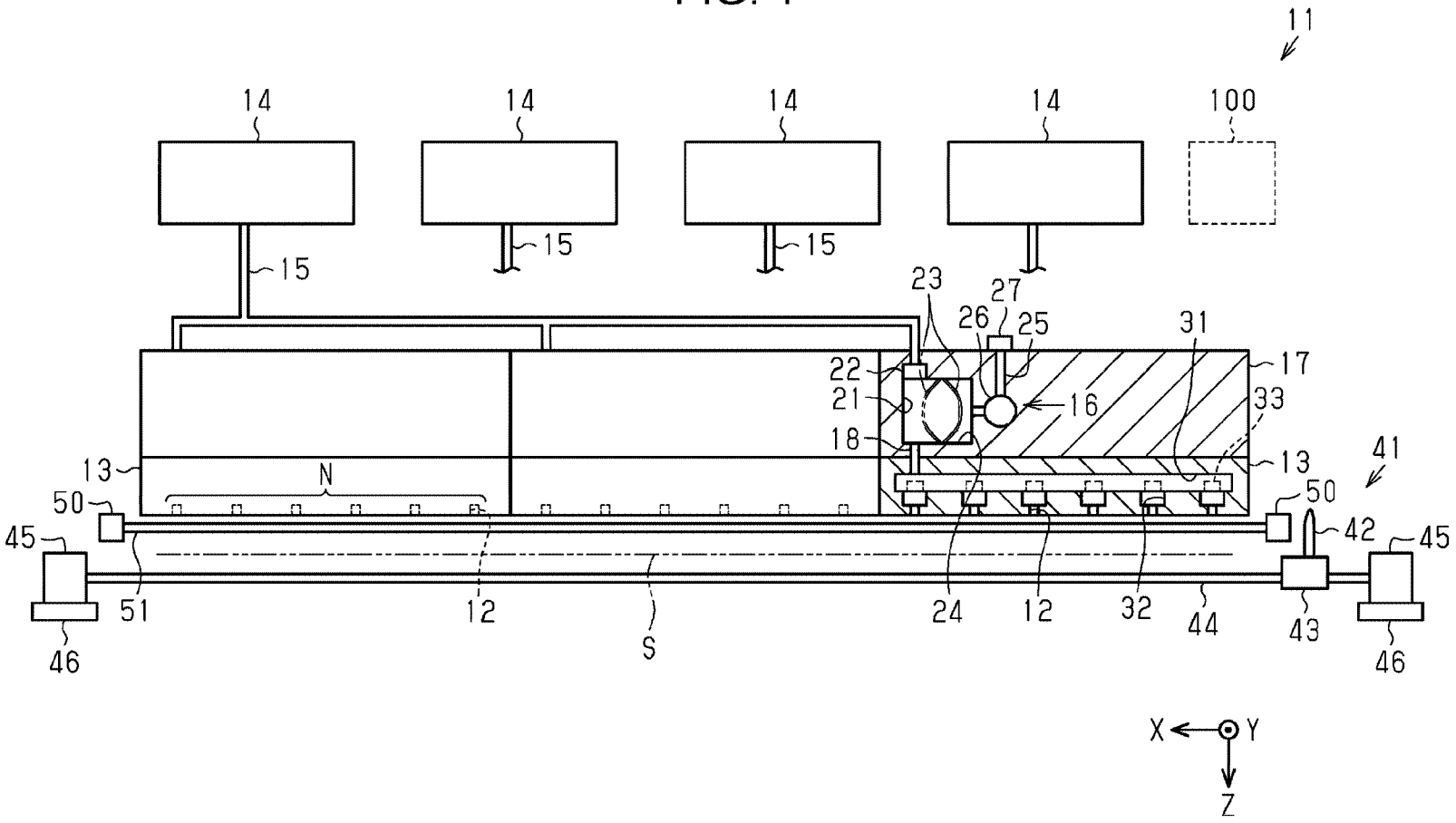
FIG. 1 is a schematic view showing a liquid ejecting apparatus according to an embodiment of the invention.

As shown in FIG. 1, a liquid ejecting apparatus 11 includes a liquid ejecting section 13 in which a plurality of nozzles 12 that can eject liquid droplets are opened, a supply path 15 to supply liquid of a liquid supply source 14 to the liquid ejecting section 13, a pressure adjusting mechanism 16 that adjusts the pressure of liquid in the liquid ejecting section 13, and a wiping apparatus 41. The liquid ejecting apparatus 11 also includes a protective member 51 that is disposed between a medium S and the liquid ejecting section 13 when the liquid ejecting section 13 ejects liquid droplets onto the medium S in an ejecting direction Z, and a control section 100 that controls the liquid ejecting section 13 and the like.

The liquid ejecting apparatus 11 according to this embodiment is an ink jet printer that performs recording (printing) by ejecting liquid (one example is ink) from the liquid ejecting section 13 onto a medium S, such as paper, to be transported in a transport direction Y which intersects the ejecting direction Z (in this embodiment, orthogonal). The position in a direction intersecting the ejecting direction Z at which the liquid ejecting section 13 ejects liquid droplets onto the medium S is referred to as a recording position.

The liquid ejecting apparatus 11 has a line head 17 that includes, as a component, a plurality of liquid ejecting sections 13. These are arranged in a row to enable a print range in a width direction X, which intersects the transport direction Y and the ejecting direction Z (in this embodiment, orthogonal), to span the entire width of the medium S. The line head 17 has a liquid path 18 to supply liquid to the liquid ejecting section 13. The pressure adjusting mechanism 16 is provided at a midpoint on the liquid path 18.

At least one liquid supply source 14 is provided. However, a plurality of (in this embodiment, four) liquid supply sources can also be provided; each liquid type (for example, each ink color) corresponds to one liquid supply source. When a plurality of liquid ejecting sections 13 are provided, the supply path 15 branches into a plurality of paths at a downstream side; each branched downstream end, which corresponds to each liquid ejecting section 13, is connected to the liquid path 18 provided on the line head 17. The liquid path 18 and the pressure adjusting mechanism 16 are provided for each liquid type on each liquid ejecting section 13.

The pressure adjusting mechanism 16 includes a pressure chamber 21 provided at a midpoint on the liquid path 18, a one-way valve 22 provided on an upstream side of the pressure chamber 21, an air chamber 24 partitioned by the pressure chamber 21 and a flexible film 23, a vent path 25 communicatively connected to the air chamber 24, a pump 26 provided at a midpoint on the vent path 25, and an on-off valve 27 provided on an end of the vent path 25. The one-way valve 22 allows flow of liquid from the liquid supply source 14 on the upstream side to the liquid ejecting section 13 on the downstream side, whereas the valve checks backflow of liquid from the downstream side to the upstream side. When the on-off valve 27 is opened with the pump 26 not driven, the vent path 25 and the air chamber 24 are communicatively connected to the atmosphere.

When the flexible film 23 is displaced flexibly, as shown by the solid line in FIG. 1, in a direction in which the air chamber 24 narrows, the pressure adjusting mechanism 16 displaces the flexible film 23 flexibly toward the pressure chamber 21, as shown by the dash-double-dot line in FIG. 1, by driving the pump 26 to introduce gas into the air chamber 24. Then, liquid in the pressure chamber 21 flows toward the liquid ejecting section 13 on the downstream side, and liquid in each nozzle 12 is pressurized. In other words, the pressure adjusting mechanism 16 functions as a pressurizing mechanism that pressurizes liquid in the liquid path 18.

In the pressure adjusting mechanism 16, the flexible film 23 may be displaced flexibly toward the pressure chamber 21 by pressing the flexible film 23 with a biasing member, such as a piston, a spring, or the like, which is disposed in the air chamber 24, instead of introducing gas with the pump 26 to displace the flexible film 23. That is to say, an arrangement that displaces the flexible film 23 may be optionally changed.

The one-way valve 22 is opened when a pressure in the liquid path 18 at a downstream side below the pressure chamber 21 is less than a default value, which is less than atmospheric pressure, whereas the valve may be configured as a differential pressure regulating valve (a self-sealing valve) to remain closed when the pressure in the liquid path 18 at the downstream side below the pressure chamber 21 is greater than or equal to the default value. According to this configuration, the pressure in the liquid path 18 at the downstream side below the pressure chamber 21 can be maintained at a negative pressure on the order of the default value by a pressure adjusting feature of the pressure adjusting mechanism 16. Thus, as a result of the negative pressure, a uniform meniscus (a curved concave liquid surface) is formed in each nozzle 12. This can increase accuracy of liquid droplet ejection and can prevent liquid leakage from each nozzle 12 due to vibration or the like. In this case, a biasing member, for example, a spring, that biases the flexible film 23 toward the air chamber 24 is installed in the pressure chamber 21 to keep the pressure chamber 21 at a negative pressure. In addition, the on-off valve 27 is opened to expose the air chamber 24 to the atmosphere, and the differential pressure regulating valve may be opened depending on a difference between a pressure (atmospheric pressure) in the air chamber 24 and a pressure of liquid in the pressure chamber 21.

The liquid ejecting section 13 includes a common liquid chamber 31 that temporarily stores liquid to be supplied through the liquid path 18 provided for each liquid type, a plurality of cavities 32 provided correspondingly for a plurality of the nozzles 12, and a plurality of actuators 33 provided correspondingly for the cavities 32. The actuators 33 are, for example, piezoelectric elements that contract and deform when energized. After the volume of each cavity 32 is increased by driving (energizing) each actuator 33, when energization is stopped, each cavity 32 is restored and deforms but decreases its volume by this restore-deform reaction. Then, liquid flows out into each nozzle 12 from each cavity 32 of which volume has been decreased, and the liquid is ejected from each nozzle 12 as a liquid droplet.

The liquid ejecting section 13 has a plurality of nozzle groups N for ejecting a plurality of types of liquid from the liquid ejecting section 13. Each nozzle group corresponds to each liquid type and is composed of a plurality of nozzles 12 that eject one type of liquid. Each nozzle group N is a group of the nozzles 12 to which liquid is supplied from one common liquid chamber 31. Each nozzle group N can be, for example, one or more nozzle rows composed of the nozzles 12 arrayed in the width direction X.

The wiping apparatus 41 includes a wiping member 42 that wipes the liquid ejecting section 13 and the protective member 51, a retaining member 43 that retains the wiping member 42, guidance shafts 44 that guide the retaining member 43 in the width direction X, a support mechanism 45 that supports the guidance shafts 44, and a movement apparatus 46 that moves the support mechanism 45 in the transport direction Y. Preferably, the support mechanism 45 is configured so that the position of the wiping member 42 can be changed in the ejecting direction Z by moving the guidance shafts 44 in the ejecting direction Z. The wiping member 42 may be, for example, a plate member made of an elastically deformable resin or may be an absorbing member, such as a cloth, that can absorb liquid.

When the liquid ejecting section 13 ejects a liquid droplet of a designated size, a minute string like liquid droplet occurs between the liquid droplet of the target size and each nozzle 12. This minute liquid droplet floats around in the form of a mist, attaching to an aperture surface 19*a* or the like. When the amount of liquid attached to the aperture surface 19*a* increases, the liquid may fall onto the medium S, or a raised medium S may come into contact with the liquid, causing the medium S to be contaminated.

Furthermore, when liquid attached to the aperture surface 19*a* gathers around each nozzle 12, a liquid droplet which has been ejected from each nozzle 12 may come into contact with that gathered liquid and change its trajectory. In addition, paper powder and dust dispersed in association with transport of a medium S made of paper may attach to the aperture surface 19*a*, become mixed with liquid and adhere thereto.

To address this issue, in the liquid ejecting apparatus 11, after the liquid ejecting section 13 has ejected a designated amount of liquid (droplets), or after a designated number of copies have been printed, the wiping apparatus 41 wipes the liquid ejecting section 13 (wiping is performed) as maintenance to remove foreign materials, such as liquid and the like, attached to the aperture surface 19*a*. When wiping is performed, the movement apparatus 46 moves the support mechanism 45 to the recording position corresponding to the liquid ejecting section 13 in the transport direction Y and moves the wiping member 42 together with the retaining member 43 along the guidance shafts 44 in the width direction X.

Before wiping, by adjusting the position of the guidance shafts 44 in the ejecting direction Z, the support mechanism 45 adjusts the contact pressure of the wiping member 42 on the liquid ejecting section 13. Wiping can be performed by the wiping member 42 reciprocating in the width direction X once or multiple times, or can be performed by the wiping member 42 moving forward only or moving backward only.

In this wiping, the movement apparatus 46 may move the wiping member 42 to the recording position as in this embodiment, or the line head 17 may be moved from the recording position to a movement area of the wiping member 42 (for example, an area upstream from the recording position in the transport direction Y).

Figure 2:
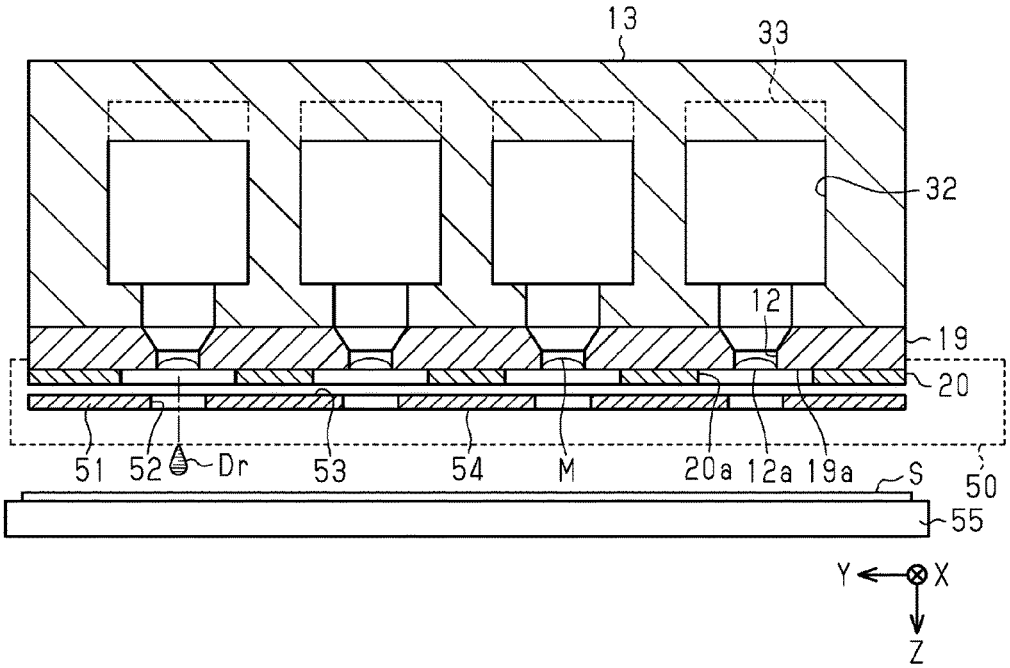
FIG. 2 is a cross-sectional view of a liquid ejecting section and a protective member when liquid droplets are ejected.

As shown in FIG. 2, the liquid ejecting section 13 includes a nozzle plate 19 through which the nozzles 12 are formed and a fixed frame 20 that holds the nozzle plate 19. In this embodiment, an opening for each nozzle 12 that ejects liquid droplets is an ejection outlet 12*a*; in the liquid ejecting section 13, an outer (bottom) surface of the nozzle plate 19 having the ejection outlet 12*a* open thereon is the aperture surface 19*a*. On the aperture surface 19*a*, a liquid-repellent film is provided to appropriately form a meniscus (a liquid surface M, which is curved and concave in response to surface tension) on the ejection outlet 12*a* or to prevent contaminated attachments.

On the aperture surface 19*a* of the liquid ejecting section 13, the ejection outlets 12*a* in the nozzle row (which eject the same kind of liquid) are arrayed in a row in the width direction of the medium S (in a row direction in which the liquid ejecting sections 13 are arrayed). Also, on the aperture surface 19*a* of the liquid ejecting section 13, a plurality of (for example, four) ejection outlets 12*a* (which eject a different kind of liquid), that is, the nozzle rows, are arrayed in a line in the transport direction Y. The fixed frame 20 is provided with a plurality of (in this embodiment, four) aperture portions 20*a*; each nozzle row or each nozzle group has an aperture portion in order to expose the aperture surface 19*a*.

During wiping of the liquid ejecting section 13, the fixed frame 20 and the aperture surface 19*a* are wiped. Repetitive wiping of the aperture surface 19*a*, however, may damage the liquid-repellent film. This may cause decreased accuracy of liquid droplet ejection or cause foreign materials to attach easily to the surface. In this embodiment, in order to prevent foreign material such as mist from attaching to the aperture surface 19*a*, the protective member 51 is disposed between the medium S and the aperture surface 19*a* when the liquid ejecting section 13 ejects liquid droplets.

The protective member 51 has passage openings 52 which enable liquid droplets Dr that the liquid ejecting section 13 ejects from the ejection outlets 12*a* to pass, and the protective member is disposed between the medium S and the aperture surface 19*a* at least when the liquid ejecting section 13 ejects the liquid droplets Dr onto the medium S. The passage openings 52 of the protective member 51 are provided in correspondence with one or more of the ejection outlets 12*a*.

Figure 6:
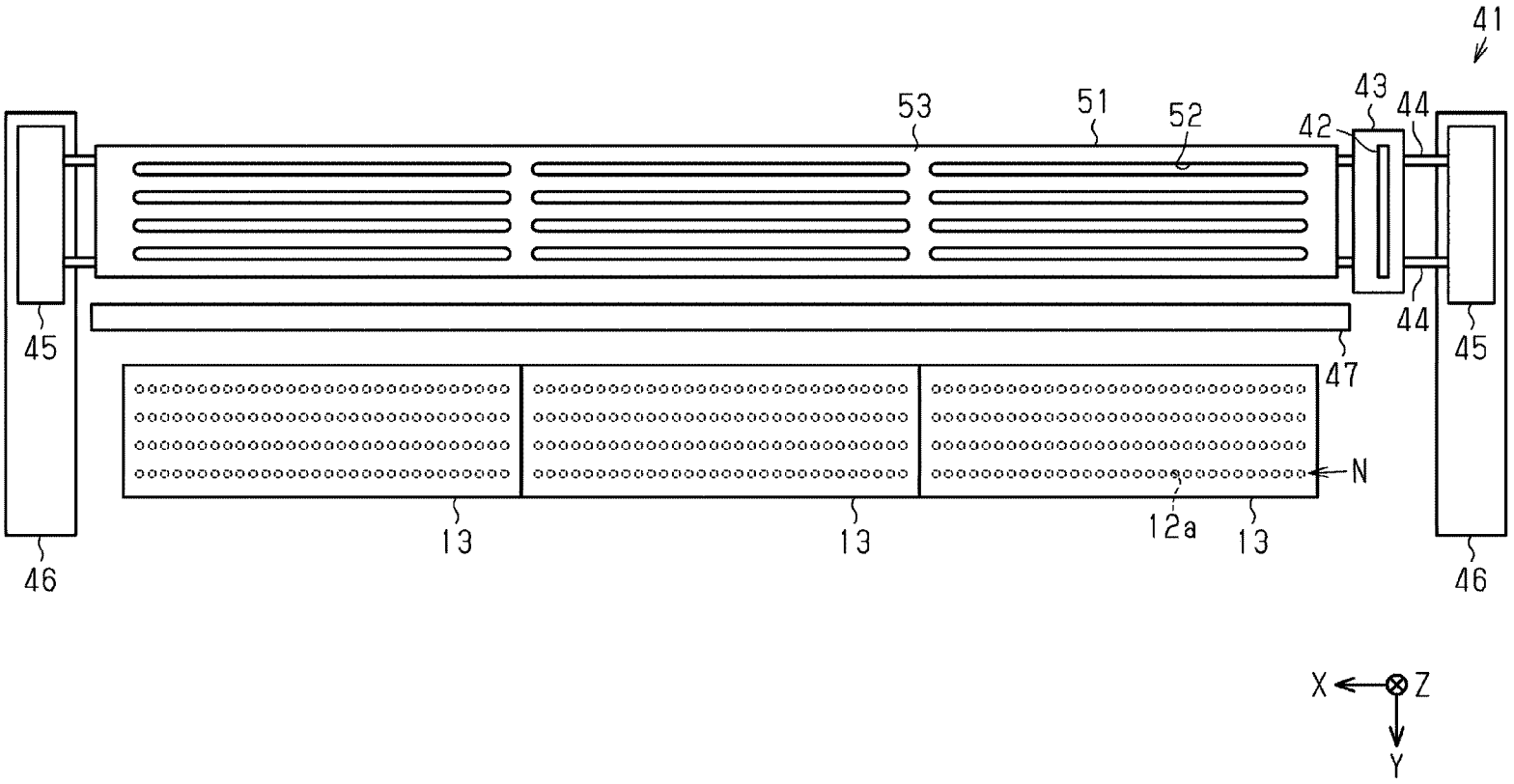
FIG. 6 is a top view of the liquid ejecting section and the wiping apparatus when the protective member is wiped.
Figure 7:
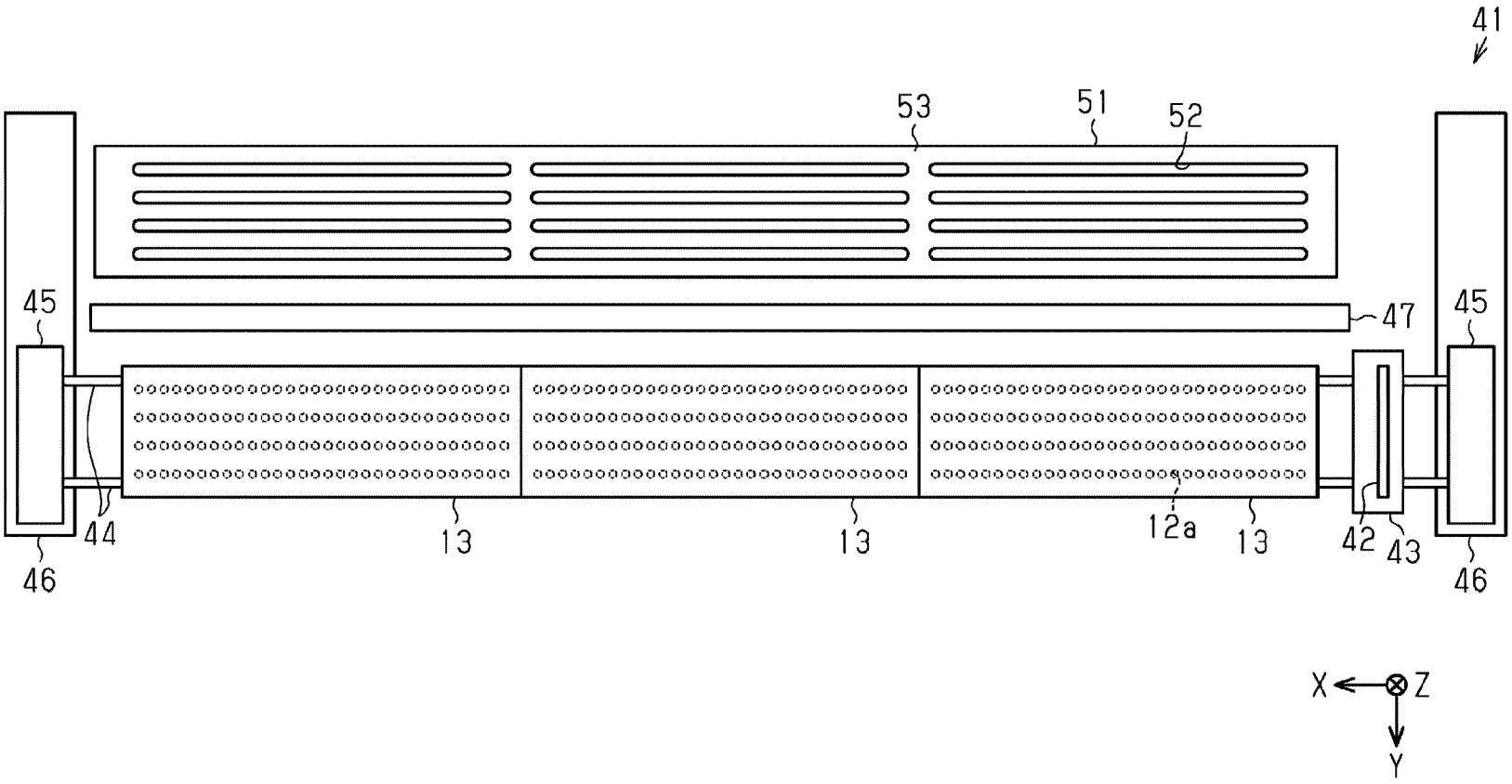
FIG. 7 is a top view of a protective member and a wiping apparatus when a liquid ejecting section is wiped.

On the protective member 51 in this embodiment, each passage opening 52 is formed so as to correspond to each nozzle row or each nozzle group in the width direction X, which is a longitudinal direction (see also FIGS. 6 and 7). Each passage opening 52 may be a notch extending from an end of the protective member 51, instead of a through hole provided on the protective member 51, which is a plate-type. It is preferred, however, that the passage openings 52 have a small opening area so that exposure area of the aperture surface 19*a* is as small as possible, while securing the opening area that enables the liquid droplets Dr to pass. Preferably, the opening area of each passage opening 52 is smaller than the opening area of each aperture portion 20*a* in the fixed frame 20, for example.

When the liquid ejecting section 13 ejects the liquid droplets Dr onto the medium S, the protective member 51 is disposed so that the ejection outlets 12*a* and the passage openings 52 align in the ejecting direction Z. The position of the protective member 51 in this case (the position shown in FIG. 2) is referred to as the protection position.

A support member 55 to support the medium S is disposed at the recording position when the liquid ejecting section 13 ejects the liquid droplets Dr onto the medium S. Thus, it could be argued that the protective member 51 is disposed between the support member 55 and the aperture surface 19*a* when the liquid ejecting section 13 ejects the liquid droplets Dr onto the medium S. When wiping is performed at the recording position, the support member 55 may be configured to be capable of retracting from the recording position to a different position during wiping.

Preferably, the protective member 51 is disposed at a position spaced from both the medium S and the aperture surface 19*a* in the ejecting direction Z and also at a position which is nearer to the aperture surface 19*a* than to the medium S when the liquid droplets Dr are ejected onto the medium S.

In this embodiment, the protective member 51 has a protection surface 53 that faces the aperture surface 19*a* at a distance to the aperture surface 19*a* when the protective member is disposed between the medium S and the aperture surface 19*a*, and an acceptance surface 54 opposite to the protection surface 53. The protection surface 53 and the acceptance surface 54 may not necessarily be flat surfaces; for example, they may have grooves and asperities to retain liquid.

It is preferable that the protective member 51, when disposed spaced from the aperture surface 19*a* of the liquid ejecting section 13, be subject to surface treatment so that its acceptance surface 54, which is a portion of the protective member 51 facing the medium S, is more liquid-repellent than its protection surface 53, which is a portion facing the liquid ejecting section 13. When there is a distance between the protective member 51 and the aperture surface 19*a* or the medium S, mist occurring during ejection of the liquid droplets Dr attaches to the protection surface 53 or the acceptance surface 54 of the protective member 51. If the acceptance surface 54 has a higher liquid-repellency, however, liquid attached to the acceptance surface 54 moves easily to the protection surface 53 through the passage openings 52 and the like. As a result, it is less likely that liquid will gather on the acceptance surface 54 or that the liquid attached to the acceptance surface 54 will cause the medium S to be contaminated.

Preferably, the liquid ejecting apparatus 11 is provided with a movement mechanism 50 that moves the protective member 51. The protective member 51 may be moved by the movement mechanism 50 in the ejecting direction Z so that the distance to the aperture surface 19*a* can be changed. Alternatively, the protective member 51 may be moved by the movement mechanism 50 in the transport direction Y or the width direction X. Such configurations enable the protective member 51 to move in the ejecting direction Z depending on the thickness of the medium S and enable the protective member 51 to retract from the recording position.

The relative position of the protective member 51 to the liquid ejecting section 13 may also be changed by moving the liquid ejecting section 13. When the liquid ejecting section 13 is configured to be movable, it is possible to adjust the contact pressure during wiping by moving the liquid ejecting section 13 instead of moving the wiping member 42 in the ejecting direction Z.

When the protective member 51 and the liquid ejecting section 13 move relative to each other, the protective member 51 and the liquid ejecting section 13 may move while in contact with each other. Preferably, the protective member 51 and the liquid ejecting section 13 move while not in contact with each other, however. When the protective member 51 moves in contact with the liquid ejecting section 13, the liquid ejecting section 13 may be damaged by the protective member 51 sliding, or foreign material may become stuck between the protective member 51 and the liquid ejecting section 13. If the fixed frame 20 holding the nozzle plate 19 is thinner than a foreign material, when the protective member 51 slides, the foreign material attached to the protective member 51 or the liquid ejecting section 13 may be dragged in contact with the aperture surface 19*a*. This may damage the aperture surface 19*a*.

Figure 3:
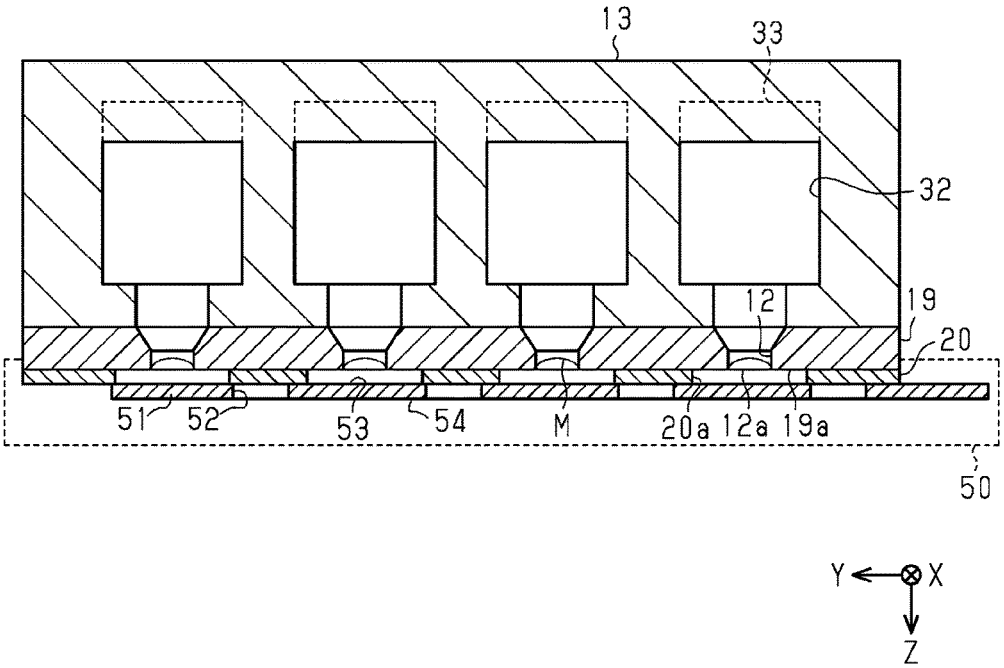
FIG. 3 is a cross-sectional view of a liquid ejecting section and a protective member when the protective member is located at a closed position.

As shown in FIG. 3, when the liquid ejecting section 13 is not ejecting liquid droplets, the protective member 51 may be moved to a closed position (the position shown in FIG. 3). At this position, the protection surface 53 for which the passage openings 52 of the protective member 51 are not formed faces the ejection outlets 12*a* and is in contact with the fixed frame 20 of the liquid ejecting section 13. Thus, the protective member 51 is disposed at the closed position which covers the ejection outlets 12*a* of the liquid ejecting section 13. Drying of the nozzles 12 can therefore be prevented when the liquid ejecting section 13 is not ejecting liquid droplets. This will avoid clogging of the nozzles 12 caused by drying of the nozzles 12 or poor ejection caused by, for example, increased viscosity of liquid in the nozzles 12.

Figure 4:
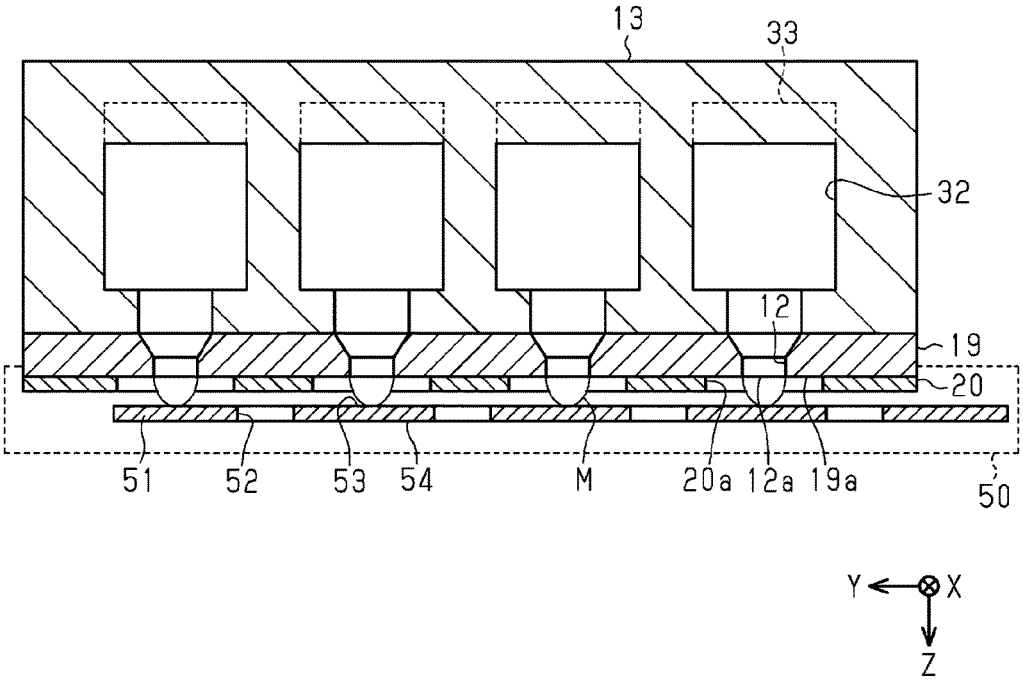
FIG. 4 is a cross-sectional view of a liquid ejecting section and a protective member when the protective member is located at a facing position.

Or, as shown in FIG. 4, when the liquid ejecting section 13 is not ejecting liquid droplets, the protective member 51 may be disposed at a facing position (the position shown in FIG. 4). At this position, the protection surface 53 at which the passage openings 52 of the protective member 51 are not formed faces the ejection outlets 12*a* and is near but not in contact with the fixed frame 20 of the liquid ejecting section 13.

When the protective member 51 is disposed at the facing position, a pressurizing feature of the pressure adjusting mechanism 16 (see FIG. 1) pressurizes liquid in the liquid path 18 that supplies liquid to the ejection outlets 12*a*, and forces out the liquid surface M, which is concave, from the ejection outlets 12*a*. The forced out liquid then attaches to the protection surface 53 and seals a gap between the ejection outlets 12*a* and the protection surface 53 with liquid, thereby preventing drying of the nozzles 12.

When the liquid ejecting apparatus 11 is not provided with the pressure adjusting mechanism 16 (the pressurizing mechanism), the gap between the ejection outlets 12*a* and the protection surface 53 may be sealed with the liquid droplets that have been ejected by the liquid ejecting section 13 onto the protection surface 53 of the protective member 51 located at the facing position. However, it is preferable to force out the liquid surface from the ejection outlets 12*a* and attach the forced out liquid to the protection surface 53. This can prevent bubbles from mixing into the nozzles 12 when the ejection outlets 12*a* are sealed with the protection surface 53 and liquid.

In such cases where liquid is allowed to attach to the protection surface 53, the protective member 51 may have a liquid-repellent film on the protection surface 53. This prevents liquid from adhering to the protection surface 53 of the protective member 51. When the liquid ejecting section 13 ejects a plurality of types of liquid, the protection surface 53 repels attached liquid. This can prevent mixing of different liquids on the protection surface 53 and mixing of a different type of liquid, instead of liquid to be ejected, into the nozzles 12.

Protection against drying of the nozzles 12 by using the protective member 51 is especially effective in cases where liquid droplets are not ejected for an extended period of time, for example, when the liquid ejecting apparatus 11 is turned off. If the protective member 51 can be used to protect against drying of the nozzles 12, a cap or the like to cover each nozzle 12 does not need to be provided for this protection purpose.

Figure 5:
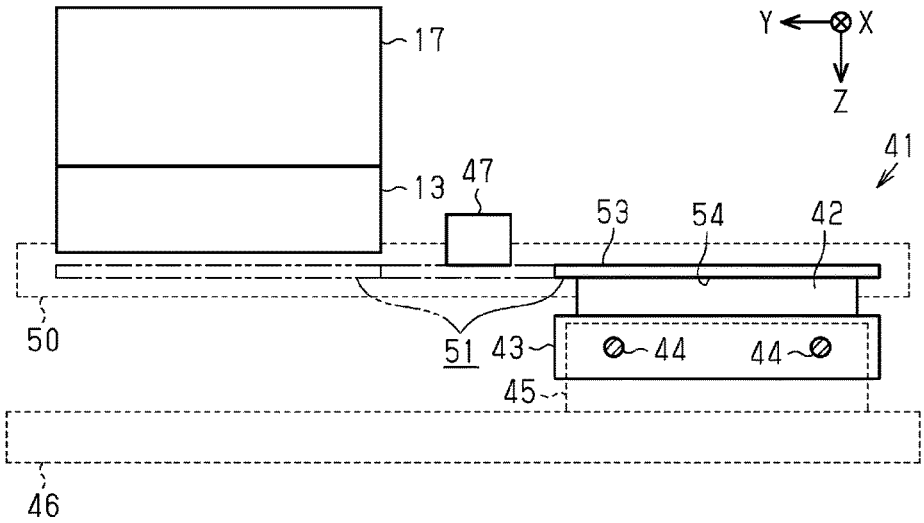
FIG. 5 is a cross-sectional view of a liquid ejecting section and a wiping apparatus when a protective member is wiped.

Preferably, as shown in FIG. 5, by use of the movement mechanism 50, the protective member 51 is capable of moving relative to the liquid ejecting section 13 between the protection position (shown by the dash-double-dot line in FIG. 5) and a retracted position (shown by the solid line in FIG. 5) which is distant from the liquid ejecting section 13 compared to the protection position. The protection position is a position which faces the aperture surface 19*a* in such a manner that the ejection outlets 12*a* and the passage openings 52 align in the ejecting direction Z for liquid droplets.

Since the protection position is also the recording position, a position to which the protective member 51 is moved from the protection position in the transport direction Y, for example, is the retracted position. By enabling the movement apparatus 46 to move the wiping member 42 from the recording position in the transport direction Y, wiping of the protective member 51 can be performed at the retracted position by the wiping member 42.

That is, after the movement apparatus 46 moves the support mechanism 45 to a position corresponding to the protective member 51 located at the retracted position, foreign material such as liquid attached to the acceptance surface 54 is wiped by moving the wiping member 42 together with the retaining member 43 along the guidance shafts 44 in the width direction X. Wiping of the protective member 51 can be performed by the wiping member 42 moving in a reciprocating manner once or multiple times, or can be performed by the wiping member 42 moving forward or backward.

In addition to the wiping member 42 that can wipe the acceptance surface 54 of the protective member 51 at the retracted position, the wiping apparatus 41 may also include a cleaning member 47 that cleans the protection surface 53 of the protective member 51. As in the wiping member 42, the cleaning member 47 may be a plate member made of an elastically deformable resin or may be an absorbing member, such as a cloth, a porous member, or the like, that can absorb liquid. Again, as in the wiping member 42, the cleaning member 47 may wipe the protection surface 53 of the protective member 51 while moving at the retracted position in the width direction X.

Or, as shown in FIG. 5, the cleaning member 47 may be disposed on a path (shown by the dash-dot line in FIG. 5) on which the protective member 51 moves from the protection position to the retracted position so that, in a process of the protective member 51 moving between the protection position and the retracted position, the cleaning member 47 performs cleaning (wiping) while in sliding contact with the protection surface 53.

As shown in FIG. 6, by moving the protective member 51 from the protection position (the recording position) to the retracted position at some midpoint during execution of recording onto the medium S by the liquid ejecting section 13, cleaning of the protection surface 53 may be done by the cleaning member 47 and wiping of the acceptance surface 54 may be done by the wiping member 42. This enables maintenance to be performed during execution of recording even when large amounts of mist occur with continuous recording done by the liquid ejecting section 13. This maintenance involves allowing the mist to attach to the protective member 51 and removing the mist by the cleaning member 47 and the wiping member 42. Therefore, in order to perform wiping of the liquid ejecting section 13, no interrupting of recording is needed.

Even when the liquid ejecting section 13 is protected with the protective member 51 to prevent mist from attaching thereto, if there is a gap between the protective member 51 and the liquid ejecting section 13, mist and the like may attach to the liquid ejecting section 13. Thus, the liquid ejecting section 13 may be wiped by the wiping member 42 in cases such as when recording ends, when the number of copies or the number of times a liquid droplet is ejected, which is set for each ejecting mode with liquid droplets of a different size, exceeds a threshold value at the time of recording, and when periodic maintenance is performed. When the control section 100 has a counter that counts the number of copies or the number of times a liquid droplet is ejected and controls a count value for comparison with the threshold value, the count value of the counter may be reset each time wiping is made by the wiping member 42.

During wiping of the liquid ejecting section 13, as shown in FIG. 7, the liquid ejecting section 13 may be wiped by moving the protective member 51 to the retracted position and moving the wiping member 42 to a position corresponding to the recording position. The contact pressure of the wiping member 42 can be set appropriately by the support mechanism 45, which adjusts the position of the wiping member 42 in the ejecting direction Z, for both wiping of the protective member 51 and wiping of the liquid ejecting section 13.

Next, operations of the liquid ejecting apparatus 11 configured as shown above will be described.

In this embodiment, the liquid ejecting apparatus 11, which includes the protective member 51, can prevent foreign material such as mist from attaching to the liquid ejecting section 13. This can reduce the frequency of wiping the liquid ejecting section 13. Thus, the load of wiping on the liquid-repellent film of the aperture surface 19*a* can be decreased.

Also, by wiping (cleaning) the protective member 51 which, instead of the liquid ejecting section 13, accepts mist and the like, the wiping apparatus 41 can prevent foreign material attached to the protective member 51 from contaminating the medium S. When the liquid ejecting section 13 is not ejecting liquid droplets, drying of the nozzles 12 can be prevented by bringing the protection surface 53 of the protective member 51 into contact with the liquid ejecting section 13 in order to cover the ejection outlets 12*a* of the liquid ejecting section 13 or by sealing the ejection outlets 12*a* with the protective member 51 and liquid.

In this way, depending on whether or not to eject liquid droplets or whether to wipe the liquid ejecting section 13 or the protective member 51, the protective member 51 can be moved to a different position. By relatively moving the member apart from the liquid ejecting section 13, however, it is possible to decrease the load on the liquid-repellent film of the aperture surface 19*a*.

The embodiments described above have the following advantages.

(1) Since the protective member 51 is disposed between the medium S and the aperture surface 19*a* when the liquid ejecting section 13 ejects the liquid droplets Dr onto the medium S, foreign material such as mist occurring in association with ejection of the liquid droplets Dr becomes attached to the protective member 51 before attaching to the aperture surface 19*a*. This can prevent the foreign material from attaching to the aperture surface 19*a* having the ejection outlets 12*a* for the liquid droplets Dr open thereon.

(2) Mist and the like occurring in association with ejection of the liquid droplets Dr become attached to the protective member 51 disposed between the liquid ejecting section 13 and the medium S. These foreign materials attached to the protective member 51 can be removed by the wiping member 42, which wipes the protective member 51 at the retracted position. By wiping the protective member 51, which accepts mist and the like instead of the aperture surface 19*a*, the frequency with which the aperture surface 19*a* is wiped can be reduced. The load of wiping on the aperture surface 19*a* can thus be decreased.

(3) The protective member 51 is configured so as to be more liquid-repellent on the portion facing the medium S than on a portion facing the aperture surface 19*a*. In this case, even when mist occurring in association with ejection of the liquid droplets Dr becomes attached to the portion of the protective member 51 facing the medium S, the liquid can be moved to the portion of the protective member 51 facing the aperture surface 19*a* through the passage openings 52 and the like. This can prevent the medium S from being contaminated with liquid attached to the portion of the protective member 51 facing the medium S (the acceptance surface 54).

(4) The cleaning member 47 cleans the protection surface 53 of the protective member 51. This can prevent foreign material attached to the protection surface 53 from attaching to the aperture surface 19*a*.

(5) When the liquid ejecting section 13 is not ejecting the liquid droplets Dr, the protective member 51 is disposed at the closed position to cover the ejection outlets 12*a*. This can prevent drying of the ejection outlets 12*a*.

(6) Liquid is forced out from the ejection outlets 12*a* when the protective member 51 is disposed at the facing position; the forced out liquid attaches to the protection surface 53. A gap between the ejection outlets 12*a* and the protection surface 53 can be sealed with liquid to prevent drying of the ejection outlets 12*a*.

(7) When the protection surface 53 of the protective member 51 has a liquid-repellent film, even the liquid which is attached to the protection surface 53 can be prevented from adhering to the protection surface 53. When the liquid ejecting section 13 ejects a plurality of types of liquid, the protection surface 53 repels attached liquid. This can prevent mixing of different liquids on the protection surface 53 and mixing of a different type of liquid, instead of liquid to be ejected, into the nozzles 12.

The embodiments described above may be modified as shown in the following examples. When practiced, the invention may be implemented with these modified examples combined with the embodiments.

Aside from the wiping apparatus that performs wiping of the liquid ejecting section 13, a wiping apparatus that performs wiping or cleaning of the protective member 51 may be provided.

The liquid ejecting apparatus 11 is not limited to a type having a line head of which the print range spans the entire width of the medium S.

Figure 8:
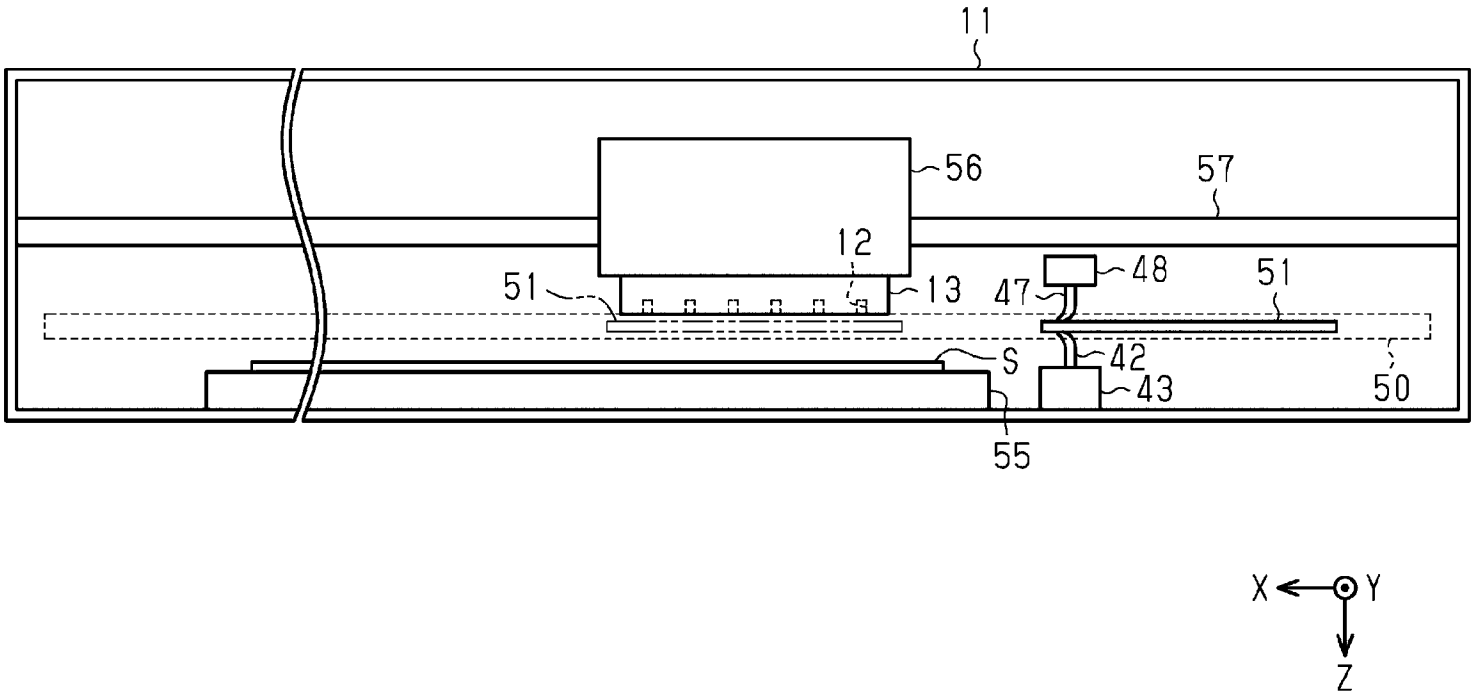
FIG. 8 is a schematic view showing a modified example of the liquid ejecting apparatus.

For example, as shown in FIG. 8, this may be a serial type apparatus that alternates between ejection of liquid, which is carried out while a carriage 56 that retains the liquid ejecting section 13 is moving along a guide shaft 57 in the width direction X, and transport of the medium S in the transport direction Y. In this case, as shown by the dash-double-dot line in FIG. 8, a movement mechanism 50 may be provided that moves the protective member 51 in the width direction X, matched with movement of a carriage 56, during ejection of liquid, or a protective member 51 may be disposed that spans the entire width of the print range.

As shown in FIG. 8, the cleaning member 47 may be configured to be retained with a retaining member 48 similar to the one in the wiping member 42; the cleaning member 47 and the wiping member 42, which extend in a direction (the transport direction Y) intersecting a wipe direction (the width direction X), may be disposed facing each other and arrayed in the ejecting direction Z. In this case, by allowing the protective member 51 to move in the width direction X and to pass between the cleaning member 47 and the wiping member 42, as shown by the solid line in FIG. 8, simultaneous wiping of the protection surface 53 and the acceptance surface 54 is possible.

Figure 9:
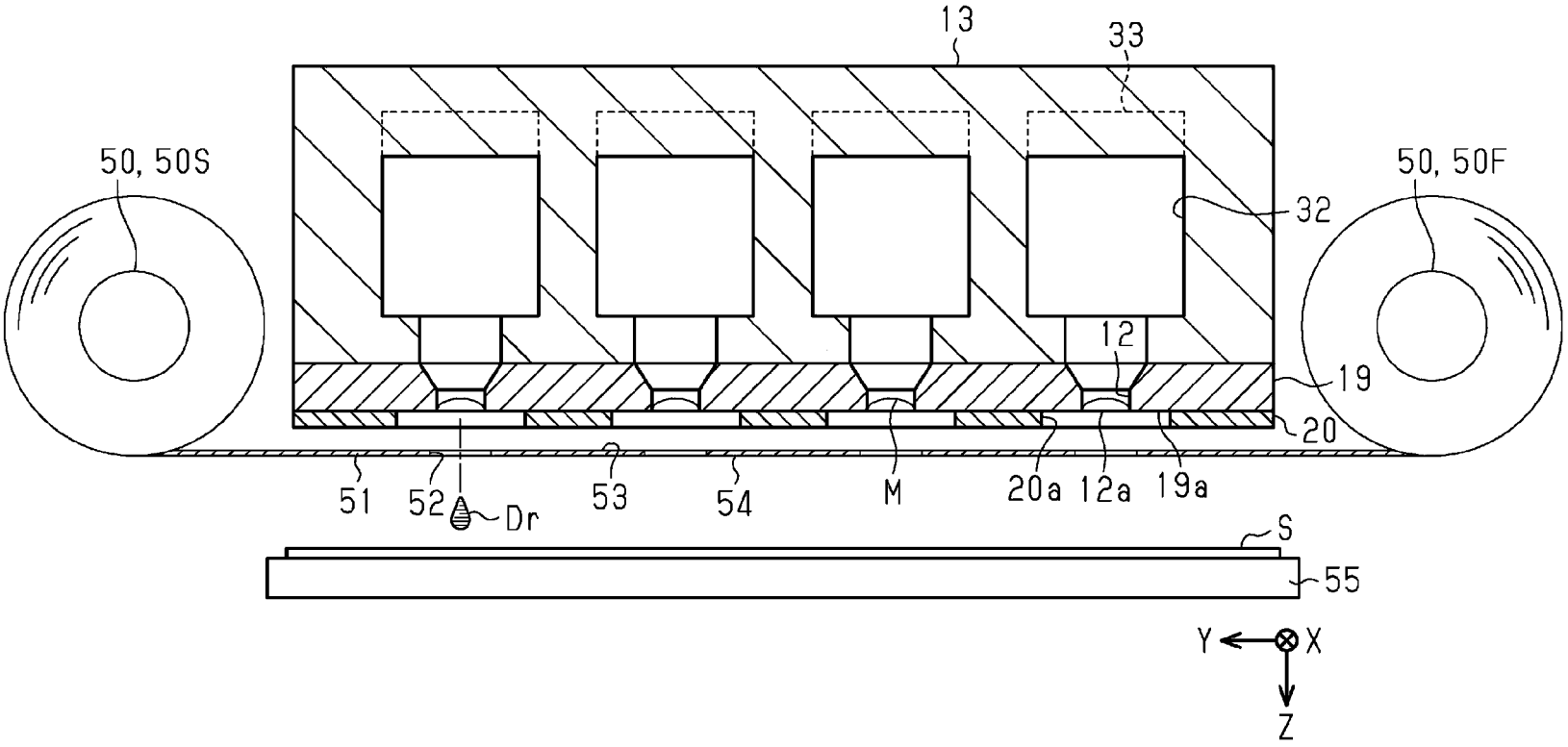
FIG. 9 is a schematic view showing a modified example of the protective member and a movement mechanism.

As shown in FIG. 9, the protective member 51 may be a sheet-type. In this case, the movement mechanism 50 that moves the protective member 51 relative to the liquid ejecting section 13 can be configured with a roller 50F that feeds out at designated intervals the sheet-type protective member 51 on which the passage openings 52 are arrayed, and a roller 50S that takes up the protective member 51. This configuration needs no wiping apparatus that performs wiping or cleaning of the protective member 51 since a contaminated portion only has to be taken up onto the roller 50S by rotating the rollers 50F, 50S when the protective member 51 is contaminated due to mist or the like.

In this configuration, when wiping of the liquid ejecting section 13 is done, the protective member 51 may be retracted to a position distant from the liquid ejecting section 13. Alternatively, at a designated position of the sheet-type protective member 51, an opening for wiping may be provided that is large enough to expose the aperture surface 19*a* entirely. By rotating the rollers 50F, 50S, the opening for wiping is disposed to align with the aperture surface 19*a* in the ejecting direction Z, and after that, wiping of the liquid ejecting section 13 may be performed through the opening for wiping.

The liquid ejecting apparatus 11 may be provided with a circulating path that circulates liquid between the supply path 15 and the liquid path 18, and a circulating pump that circulates liquid on the circulating path. This configuration is desirable because it can avoid sedimentation of components in response to circulation when liquid containing components having a sedimentation property is used, for example, in such a case where liquid ink is a pigment ink containing pigments. Even when liquid does not contain such components, it is preferable that a bubble trap be provided at a midpoint on the path to circulate liquid. This can collect bubbles with liquid circulation. When this circulating pump is provided, the circulating pump may function as a pressurizing mechanism to force out the liquid surface M from the ejection outlets 12*a*. Namely, liquid in the liquid path 18 may be pressurized by driving the circulating pump to circulate liquid.

When the liquid ejecting apparatus 11 includes a pressurizing mechanism, wiping may be performed with the liquid surface M forced out from the ejection outlets 12*a* by means of pressurization. In this case, the wiping member 42 will not push foreign material, such as bubbles, into the nozzles 12 during wiping. Again, when the liquid ejecting apparatus 11 includes the pressurizing mechanism, pressurized cleaning may be performed at a designated timing. This pressurized cleaning involves discharging liquid from the nozzles 12 by pressurization. In this case, pressurized cleaning can discharge foreign material, such as bubbles, which are mixed into the liquid ejecting section 13. In this way, the pressurizing mechanism can be used for multiple purposes to do a wide range of maintenance operations while preventing an increase in the complexity of units.

In contrast with print operations, as a maintenance operation to remove foreign material, such as bubbles, which are mixed into the nozzles 12, flushing may be performed in which liquid droplets are flushed out from the nozzles 12. In this case, a separate flushing box may be provided to accept flushed out, or discharged, liquid droplets. Alternatively, the protection surface 53 of the protective member 51 may accept these flushed out liquid droplets. When the flushed out liquid droplets are accepted by the protective member 51, it is preferable that the distance between the protection surface 53 and the aperture surface 19*a* in the ejecting direction Z be longer than the distance during printing to prevent liquid accepted by the protection surface 53 from attaching to the aperture surface 19*a*.

Liquid that the liquid ejecting section ejects is not limited to ink, and may be, for example, a liquid material in which particles in a functional material are dispersed or mixed into a liquid. The invention may be configured to perform recording by ejecting a liquid material containing a dispersed or dissolved material, such as an electrode material or a coloring material (a pixel material), used to manufacture a liquid crystal display, an electroluminescent display, or a surface emitting display, for example.

The medium is not limited to paper, and may be a thin plate member, a plastic film or the like, or may be a fabric used for a textile printing unit or the like. Moreover, the medium is not limited to a sheet- or plate-type, and may be clothes, such as T-shirts, for example, or three-dimensional objects such as tableware and stationery.

The entire disclosure of Japanese Patent Application No. 2015-178235, filed Sep. 10, 2015 is expressly incorporated by reference herein.

What is claimed is:

1. A liquid ejecting apparatus comprising:

a liquid ejecting section with an aperture surface having ejection outlets that eject liquid droplets; and a protective member having passage openings that enable the liquid droplets to pass, the protective member being disposed between a medium and the aperture surface when the liquid ejecting section ejects liquid droplets onto the medium, wherein the protective member is disposed spaced from the aperture surface, and wherein the protective member is more liquid-repellent on a portion facing the medium than on a portion facing the liquid ejecting section.

2. The liquid ejecting apparatus according to claim 1, further comprising a cleaning member arranged to clean a protection surface of the protective member, wherein the protection surface faces the aperture surface when the protective member is disposed between the medium and the aperture surface.

3. The liquid ejecting apparatus according to claim 1, wherein the protective member is disposed at a closed position to cover the ejection outlets when the liquid ejecting section is not ejecting liquid droplets.

4. The liquid ejecting apparatus according to claim 1, further comprising a pressurizing mechanism that, when the protective member is disposed at a facing position, pressurizes liquid in a liquid path to force out a liquid surface from the ejection outlets, wherein the liquid ejecting section includes the liquid path that supplies liquid to the ejection outlets; the protective member has a protection surface that faces the aperture surface when the protective member is disposed between the medium and the aperture surface, the protection surface being disposed at a facing position that faces the ejection outlets when the liquid ejecting section is not ejecting liquid droplets.

5. The liquid ejecting apparatus according to claim 4, wherein the protection surface of the protective member includes a liquid-repellent film.

6. A liquid ejecting apparatus comprising:

a liquid ejecting section with an aperture surface having ejection outlets that eject liquid droplets;

a protective member having passage openings that enable the liquid droplets to pass, the protective member being disposed between a medium and the aperture surface when the liquid ejecting section ejects liquid droplets onto the medium; and a wiping member capable of wiping the protective member at a retracted position, wherein the protective member is capable of moving relative to the liquid ejecting section between a protection position and the retracted position that is distant from the liquid ejecting section compared to the protection position, the protection position being a position that faces the aperture surface in such a manner that the ejection outlets and the passage openings align in a liquid droplet ejecting direction.

7. A liquid ejecting apparatus comprising:

a liquid ejecting section having ejection outlets that eject liquid droplets; and a protective member having passage openings that enable the liquid droplets to pass, the protective member being disposed between a medium and the liquid ejecting section when the liquid ejecting section ejects liquid droplets onto the medium, wherein the protective member is disposed spaced from the liquid ejecting section, and wherein the protective member is more liquid-repellent on a portion facing the medium than on a portion facing the liquid ejecting section.

8. The liquid ejecting apparatus according to claim 7, further comprising a wiping member capable of wiping the protective member at a retracted position, wherein the protective member is capable of moving relative to the liquid ejecting section between a protection position and the retracted position that is distant from the liquid ejecting section compared to the protection position, the protection position being a position that faces the aperture surface in such a manner that the ejection outlets and the passage openings align in a liquid droplet ejecting direction.

9. The liquid ejecting apparatus according to claim 7, further comprising a cleaning member arranged to clean a protection surface of the protective member, wherein the protection surface faces the aperture surface when the protective member is disposed between the medium and the aperture surface.

* * * * *